US005773748A

United States Patent [19]

Makowiecki et al.

[11] Patent Number: 5,773,748

[45] Date of Patent: Jun. 30, 1998

[54] LIMITED-LIFE CARTRIDGE PRIMERS

[75] Inventors: Daniel M. Makowiecki, Livermore; Robert S. Rosen, San Ramon, both of Calif.

[73] Assignee: Regents of the University of California, Oakland, Calif.

[21] Appl. No.: 490,407

[22] Filed: Jun. 14, 1995

[51] Int. Cl.[6] ..... B41F 1/40

[52] U.S. Cl. ..... 102/205; 149/15

[58] Field of Search ..... 102/205; 149/15

[56] References Cited

U.S. PATENT DOCUMENTS

| | | | |
|---|---|---|---|
| 3,882,323 | 5/1975 | Smolker | 307/202 A |
| 4,014,963 | 3/1977 | Gawlick et al. | 102/45 |
| 4,464,989 | 8/1984 | Gibson et al. | 102/202.5 |
| 4,606,146 | 8/1986 | Danen et al. | 149/15 |
| 5,090,322 | 2/1992 | Allford | 102/202.7 |
| 5,266,132 | 11/1993 | Danen et al. | 149/15 |
| 5,505,799 | 4/1996 | Makowiecki | 149/15 |
| 5,525,170 | 6/1996 | Stark et al. | 149/85 |

*Primary Examiner*—Edward A. Miller
*Attorney, Agent, or Firm*—L. E. Carnahan; Henry R. Sartorio

[57] ABSTRACT

A cartridge primer which utilizes an explosive that can be designed to become inactive in a predetermined period of time: a limited-life primer. The explosive or combustible material of the primer is an inorganic reactive multilayer (RML). The reaction products of the RML are sub-micron grains of non-corrosive inorganic compounds that would have no harmful effects on firearms or cartridge cases. Unlike use of primers containing lead components, primers utilizing RML's would not present a hazard to the environment. The sensitivity of an RML is determined by the physical structure and the stored interfacial energy. The sensitivity lowers with time due to a decrease in interfacial energy resulting from interdiffusion of the elemental layers. Time-dependent interdiffusion is predictable, thereby enabling the functional lifetime of an RML primer to be predetermined by the initial thickness and materials selection of the reacting layers.

22 Claims, 6 Drawing Sheets

LIMITED-LIFE CARTRIDGE PRIMERS

The United States Government has rights in this invention pursuant to Contract No. W-7405-ENG-48 between the United States Department of Energy and the University of California for the operation of Lawrence Livermore National Laboratory.

BACKGROUND OF THE INVENTION

This invention relates to ammunition, particularly to primers, and more particularly to the use of an inorganic reactive multilayer (RML) as the primary chemical initiator in order to control the usable life-time of cartridges and detonators for explosives.

Cartridge primers, are the initial explosive train component in ammunition consisting of a cartridge case, propellant, and projectile. Cartridge primers generally consist of a thin metal cup, a metal anvil, and an explosive protected by foil and sealed with lacquer. The explosive or primary initiator is a shock-sensitive material such as fulminate of mercury, potassium chlorate, or lead styphnate. Lead styphnate has been used as the primary initiator in primers for the past fifty years. These cartridge primers have a virtually unlimited shelf-life. It is not surprising that the performance and reliability of ammunition that has been stored properly for more than fifty years is indistinguishable from new ammunition. Hence, ammunition manufactured with primers using modern chemical initiators can be expected to remain functional indefinitely. This quality is essential to the stockpiling of ammunition required by the military. However, this quality also creates a potentially dangerous situation because it allows anyone to stockpile large quantities of ammunition without any anticipated legitimate use. Subversive individuals and groups are therefore able to "out-gun" law enforcement personnel attempting to execute lawful search and arrest warrants because of the nearly endless amount of ammunition that can be expended from a fortified position in an armed conflict.

Recently, there have been efforts to impose increasingly stricter gun-control measures by state and federal legislatures, as well as a call for "safer bullets" by the U.S. Surgeon General, in order to reduce the occurrence of violent crime. The effectiveness of new gun control legislation is the subject of much debate due to loop-holes in the laws and, perhaps, more importantly, the number of firearms already owned by the general public (estimated to be as high as 200 million firearms nationwide). There is a need for alternate methods of reducing the occurrence of gun related violence, such as controlling the availability of ammunition. One method of controlling the availability of ammunition that has been suggested is to limit its usable service-life. It is generally accepted that limiting the shelf-life of the primer is the most efficient method of controlling the usable service life of ammunition, because the complexity of the primer makes it the most difficult cartridge component to duplicate or replace.

While prior efforts have been contemplated to reduce the long shelf-life problem, no solution has yet been found. For example, one of the largest suppliers of primers to the ammunition reloader, CCI, has stated, "On the shelf life issue, our chemists have decades of experience in designing chemical initiators, and they know of no way to 'kill' a primer after two years that won't kill it tomorrow. The chemical technology to limit shelf life simply does not exist. Primer shelf life is measured in decades (see Shooting Times/September 1994, "Precision Reloading" by Rick Jamison, pp. 28–32 and 35).

The present invention fills the above-mentioned needs by providing a method of controlling the availability of ammunition by limiting the functional shelf-life of the primer, and thus offers an alternate and simple method of reducing the occurrence of firearms-related violence.

SUMMARY OF THE INVENTION

It is an object of the present invention to provide a method for effectively controlling the shelf-life of ammunition.

A further object of the invention is to provide cartridge primers with a limited functional shelf-life.

A further object of this invention is to limit the functional life of ammunition by controlling the shelf-life of the primer.

Another object of the invention is to provide a cartridge primer with a primary initiator explosive material composed of an inorganic reactive multilayer.

Another object of the invention is to use the time-limited explosive properties of the inorganic reactive multilayer to control the functional shelf-life detonators used to initiate explosives.

Another object of the invention is to provide a Boxer type cartridge primer having a metal cup, a metal anvil, and a primary initiator that is a time-limited explosive composed of an inorganic reactive multilayer material.

Another object of the invention is to prevent extension of shelf-life of a primary initiator containing an inorganic reactive multilayer material by adding a quantity of material that has a change at low temperature including one of: a destructive phase change, a thermal contraction change, and an internal stress change.

Another object of the invention is to provide an explosive detonator or cartridge primer that uses an inorganic reactive multilayer to ignite the standard chemical initiators used in commercially available detonators and primers.

Another object of the invention is to provide methods for fabricating limited-life cartridge primers wherein the functional service life of the primer can be predetermined by the structural design and material composition selected for the inorganic reactive multilayer (RML) used as the primary initiator.

Another object of this invention is to provide a design for a primer using a RML that can be initiated electrically with the spark from a low-voltage battery.

Other objects and advantages of the invention will become apparent from the following description and accompanying drawing. Basically, the present invention comprises a primer that utilizes a primary initiator or explosive that can be designed to become inactive in a predetermined period of time. The primary initiator or explosive is a synthetic inorganic material consisting of many layers of reactive elements, such as titanium-boron. The detonation or ignition sensitivity of these reactive multilayer materials is attributed to the interfacial energy stored in the metastable structure. The ignition sensitivity of the reactive multilayer degrades with time because interdiffusion of atoms reduces the excess energy stored at the layer interfaces. Thus, the usable life-time of the primer can be determined by the proper selection of the reacting elements and the design of the multilayer structure.

Limiting the shelf-life of a cartridge primer as described in this invention is accomplished by using a new type of primary initiator. The shock-sensitive chemical initiator used in the limited-life cartridge-primers is an inorganic reactive multilayer (RML). An RML is a synthetic material with a modulated structure consisting of many thin layers of reactive elements such as boron and titanium. The combustion properties of a reactive multilayer such as energy and reactivity are primarily determined by the selection of reacting elements. The shock-sensitivity of an RML is a result of the metastable interface structure between reacting layers and the thickness of the layers. Reacting multilayers are generally synthesized by a vacuum coating process such as sputtering; consequently, these properties can be controlled by modifying its modulated structure.

Unlike the explosives currently used as the chemical initiator in primers, the shock-sensitive reactivity of a RML changes with time because interdiffusion of atoms reduces the excess energy stored at the metastable interfaces. The rate of this process is unique for a particular combination of elements, and the net result is that atoms tend to migrate from a region of high concentration to a region of lower concentration. The change in the rate of atomic diffusion with temperature is known to follow an Arrhenius relationship, whereby the diffusion rate is proportional to the exponential of temperature. The time period when a RML will function as a shock-sensitive explosive can be determined and controlled by selecting a combination of elements with appropriate diffusion characteristics. The primary initiators currently used in commercial cartridge primers have metastable molecular structures that do not change by a simple atomic diffusion process; consequently, they do not exhibit this predictable change in reactivity.

This invention includes two basic designs for limited-life cartridge primers that use reactive multilayers as the primary chemical initiator. The first design simply replaces the chemical initiator with a comparable amount of RML in the standard Boxer primer. The second design is a modified version of the Boxer primer that uses a small amount of RML to ignite a standard chemical initiator. The later design would minimize both increases in manufacturing costs related to materials and changes in primer performance.

This invention also includes a design for a new primer using a RML that can be initiated electrically with the spark from a nine volt battery.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

Figure 1A:
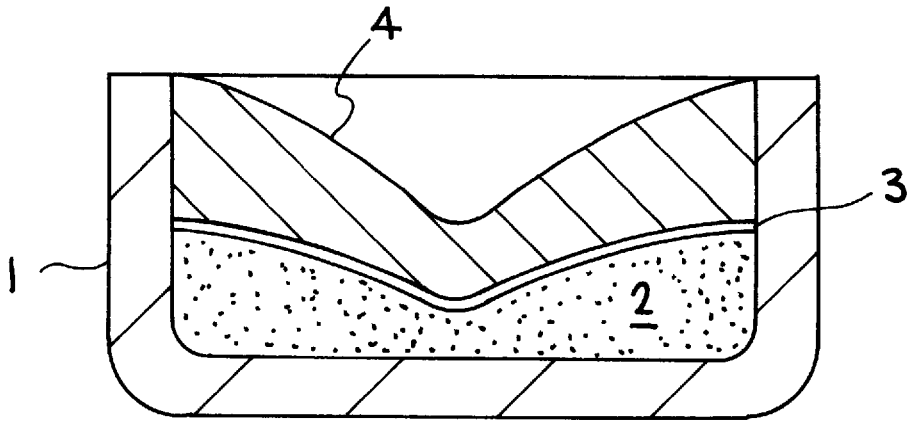
FIG. 1A (PRIOR ART)
FIG. 1A illustrates in cross-section the components of a prior art cartridge primer.

The present invention involves a simple and effective method of controlling the availability of ammunition by controlling the shelf life of the primer or detonator. It involves replacing the shock-sensitive organic explosive used in cartridge primers, for example, with an inorganic reactive multilayer (RML) that functions as an explosive for a limited period of time. RML's are modulated structures consisting of very thin (1 to 1000 nm) alternating layers of two or more reactive elements and/or inorganic compounds, such as titanium-boron (Ti—B), titanium-silicon (Ti—Si), nickel-silicon (Ni—Si), beryllium-carbon (Be—C), and aluminum-platinum (Al—Pt); or three material alternating layers of reactive elements and an inorganic compound, such as titanium-carbon-copper oxide (Ti-C-CuO), aluminum-carbon-copper oxide (Al-C-CuO), and beryllium-carbon-copper oxide (Be-C-CuO). Individual layer thicknesses of RML designs can vary from less than one nanometer (nm) to more than several micrometers ($\mu$m). RML's are generally prepared by vacuum deposition processes. The energy stored in the large number of metastable layer interfaces (100s to 10,000) is responsible for their unusual sensitivity to reaction.

RML's have energy densities comparable to organometallic initiator explosives, such as lead styphnate, and RML's are essentially unaffected by moisture or solvents. However, time-dependent interdiffusion of the elements occurring at the layer interfaces in the RML reduces stored energy and reactivity. The interdiffusion process is a function of time at temperature and is a characteristic of the material composition of the multilayer. Consequently, the reacting elements and inorganic compounds and the individual layer thicknesses can be designed to determine the time at ambient conditions that a RML will function as an initiator-type explosive. The reaction products of RML's are sub-micron grains of non-corrosive inorganic compounds that would have no harmful effects on firearms or cartridge cases. Unlike most commercial primers that contain lead compounds, primers utilizing RML's would not present a hazard to the environment.

The storage temperature can have a significant effect on the expected performance life-time of a life-limited cartridge primer (LLCP) due to the temperature dependent interdiffusion of the reacting elements in the RML. Previous studies performed using various different multilayer combinations have determined that interlayer growth obeys a square-root time-dependence, suggesting that interlayer growth is diffusion-limited. It is this property of multilayers that leads to, over a period of time at temperature, an intermixed structure which is eventually no longer capable of reacting explosively. The amount of intermixing within the RML, after a given storage time, can be related to a quantity known as the interdiffusion coefficient. Empirically it is found that the interdiffusion coefficient is a function of temperature and a quantity known as the activation energy of interdiffusion. Previous studies on RML's have reported activation energies of from 0.3 to 3.0 eV, suggesting large variations in thermal stability at ambient temperatures depending upon the magnitude of the activation energy. Assuming that the LLCP's would be subjected to storage temperature extremes of 0° to 50° C., and assuming also that the corresponding maximum and minimum shelf-life extremes are selected as 5 years and 6 months, respectively, then the requisite RML activation energy would be within the range of experimentally reported values and, hence, achievable using existing material combinations.

The shelf-life of a LLCP could be extended indefinitely by storing them at temperatures significantly below ambient, where interdiffusion of the elements is very slow. However, this method of extending the functional life-time of the LLCP is prevented in this invention by incorporating a material in the multilayer structure that exhibits at least one of the following characteristics: 1) a destructive phase change at low temperatures, such as displayed with pure tin; 2) a coefficient of thermal expansion (CTE) that differs significantly from the primer cup and/or RML; or 3) internal or residual stress rendering the structure mechanically unstable with respect to changes in temperature. For example, pure tin when cooled to 13.2° C., transforms from the beta phase with a diamond-cubic crystal structure to the alpha phase with a body-centered tetragonal crystal structure. In the past, this transformation was referred to as "Tin-Pest" because the silver-metallic beta-Sn would crumble into a gray dust. Adding a pure tin layer to the base of the RML or incorporating a layer of pure tin in the RML structure will cause the RML to disintegrate (by the first-named characteristic) at temperatures below the phase transformation temperature. Consequently, a LLCP containing a RML with a pure tin layer would not function at ambient temperatures if it had been previously stored at temperatures below the transformation temperature, or adding a layer with a CTE that differs significantly from the primer cup and/or RML will cause the layer to delaminate from the primer cup and/or RML at temperatures significantly below ambient. Similarly, an additional layer with high residual stresses would also be subject to mechanical failure (de-lamination) at temperatures significantly below ambient.

Limited-life cartridge primers (LLCP's) using RML's of this invention would allow the manufacture of ammunition that would remain functional for a limited, predetermined period of time. This would enable the government to restrict the ability civilians would have to stockpile large quantities of ammunition, thereby impeding the ability of subversives to engage in protracted armed conflict with law enforcement. This would also reduce occurrences of accidental shootings by children encountering long-since forgotten, loaded firearms. The use of LLCP's would have only minimal effects on citizens involved in law-abiding activities such as target shooting and hunting. Ammunition would have to be purchased at more frequent intervals (e.g., annually) for legitimate planned or anticipated uses. This would lead to increased commercial profits (as well as increased potential tax revenues) generated from the additional sales required to replace non-functional ammunition.

The limited-life primer of this invention could improve the long-term safety of commercial explosives other than ammunition primers, such as detonators and blasting caps, by restricting their functional lifetime. Thus, accidents caused, for example, by children playing with detonators or blasting caps discovered many years later in prior blasting areas, could be reduced or eliminated entirely.

The limited-life cartridge primers, utilizing RML's as the explosive material can be fabricated, for example, by three (3) methods that are compatible with existing primer manufacturing technology. In one method, the appropriate RML can be directly deposited in the cup portion of the primer assembly by vacuum coating techniques (i.e., sputtering, evaporation), described in detail hereinafter. In another method, the RML can be fabricated in a separate process, converted into a powder, and used in place of the standard organic initiator explosive, as set forth below. In this method the RML material can be made by processes other than atomic deposition such as cold-rolling elemental ribbons into a multilayer structure. In another method small preformed shapes can be cut from the RML foils or RML films deposited on thin aluminum foil, for example, and placed directly into the primer cups, with details set forth below. Experiments utilizing this latter method have shown that detonation of the RML causes the aluminum foil to combust thereby increasing the energy released in the explosion.

As utilized herein, the term foil is defined as free-standing substrate or member, while the term film is defined as a thin coating (single or multiple layer) deposited on a foil or substrate. The film (single layer or multilayer) may in some instances be removed from the foil or substrate after deposition and thus be free-standing.

Figure 1B:
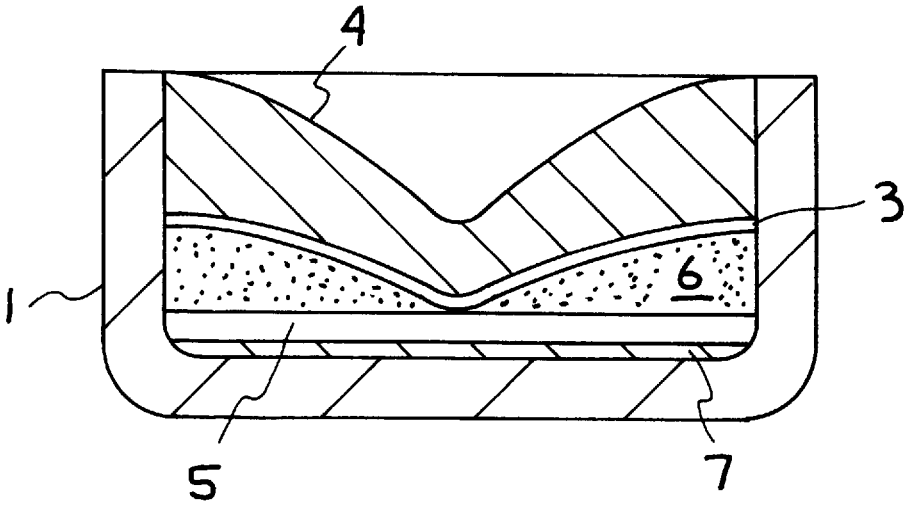
FIG. 1B illustrates the FIG. 1A cartridge primer modified with RML in accordance with the present invention.
Figure 2:
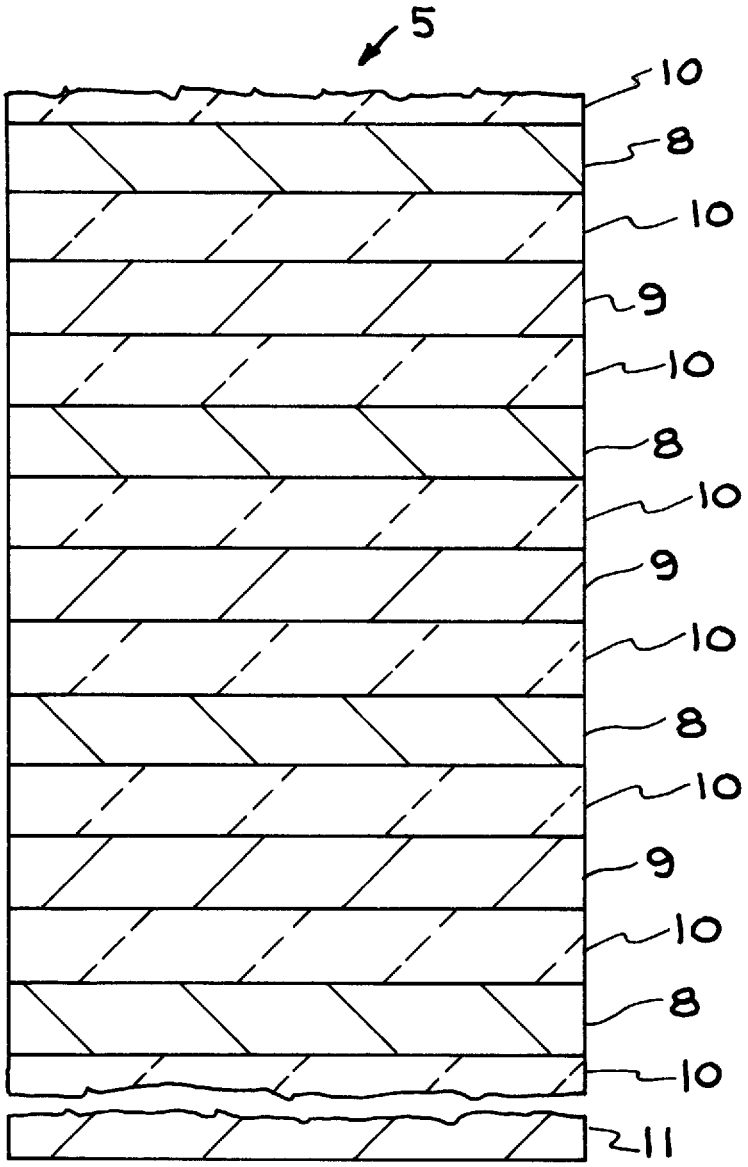
FIG. 2 is a partial enlarged view of a three material reactive multilayer made in accordance with the invention.

An embodiment of a prior art Boxer type cartridge primer is illustrated in FIG. 1A, and basically comprises a cup 1 within which is located an explosive mixture 2, a foil or paper 3, and an anvil 4. The primer of FIG. 1A is modified as shown in FIG. 1B by replacing the explosive mixture 2 with an inorganic reactive multilayer (RML) 5, as seen in FIGS. 2 and 3A (with or without the foil 3 of FIG. 1A); and/or with powder 6 from an inorganic reactive multilayer, and which may or may not utilize the foil 3. A thin (0.5 to 2.0 $\mu$m) layer 7 of pure tin, for example, is position in cup 1, but can be added to the RML 5.

Prior to a detailed description of the three element multilayer (FIG. 2) and the two element multilayer (FIGS. 3A and 3B), there is a basic difference these two types of RML's. The three (3) element RML is an explosive which produces a working fluid or expanding gas (i.e., CO) and high temperature, and such is described and claimed in copending U.S. application Ser. No. 08/120,407, filed Sep. 13, 1993, entitled "Nano-Engineered Explosives", and assigned to the same assignee. The two (2) element RML produces high temperature, but no expanding gas. Both types of RML's can effectively ignite a cartridge powder charge, as shown in the FIGS. 6 and 7 embodiment. A two element RML is simpler and less expensive to fabricate. Both the three element and two element RML's can be fabricated utilizing the apparatus of FIG. 4, but with different operational sequences. The multilayers of FIGS. 2 and 3A–3B may include material, such as pure tin, that has a destructive phase change at low temperatures. It may be possible to utilize other material than tin, which has a destructive phase change at low temperatures, such as by the addition of small amounts (less than 1 atom percent) of another material such as antimony. However, such has not been experimentally verified and may have adverse effects. Tin is the only thus far verified material.

FIG. 2 is an enlarged partial view of an embodiment of a three material reactive multilayer (RML) structure using a sequence of Ti—C—CuO layers, that will detonate and combust at high velocities generating a working fluid, such as carbon monoxide (CO), and high temperatures. This embodiment comprises a multilayer structure 5 of repeated submicron layers of titanium (Ti) and copper oxide (CuO), indicated at 8 and 9, with a submicron layer 10 of carbon (C) between each of the Ti layers 8 and CuO layers 9 to prevent unwanted passivation reactions. Each of the layers (8–10) having a thickness, for example, between 10 angstroms and one micrometer (10,000 Å). The number of layers in the structure 5 may vary from about 100 to 10,000, depending on the specific application. At least one layer 11 of tin may be added to the RLM 5 of FIG. 2. The tin is preferably pure tin with the layer thickness of 5000 Å. The layer 11 of tin may be located elsewhere in the multilayer or more than one layer of tin may be utilized.

The reaction of metals (i.e. Al, Ti, Be . . . ) with inorganic oxides (i.e. CuO, $Fe_2O_3$ to produce $Al_2O_3$ and Fe is referred to as a Thermite reaction. The reaction of Al metal and $Fe_2O_3$ has long been used in metallurgical processes, such as welding.

Figure 4:
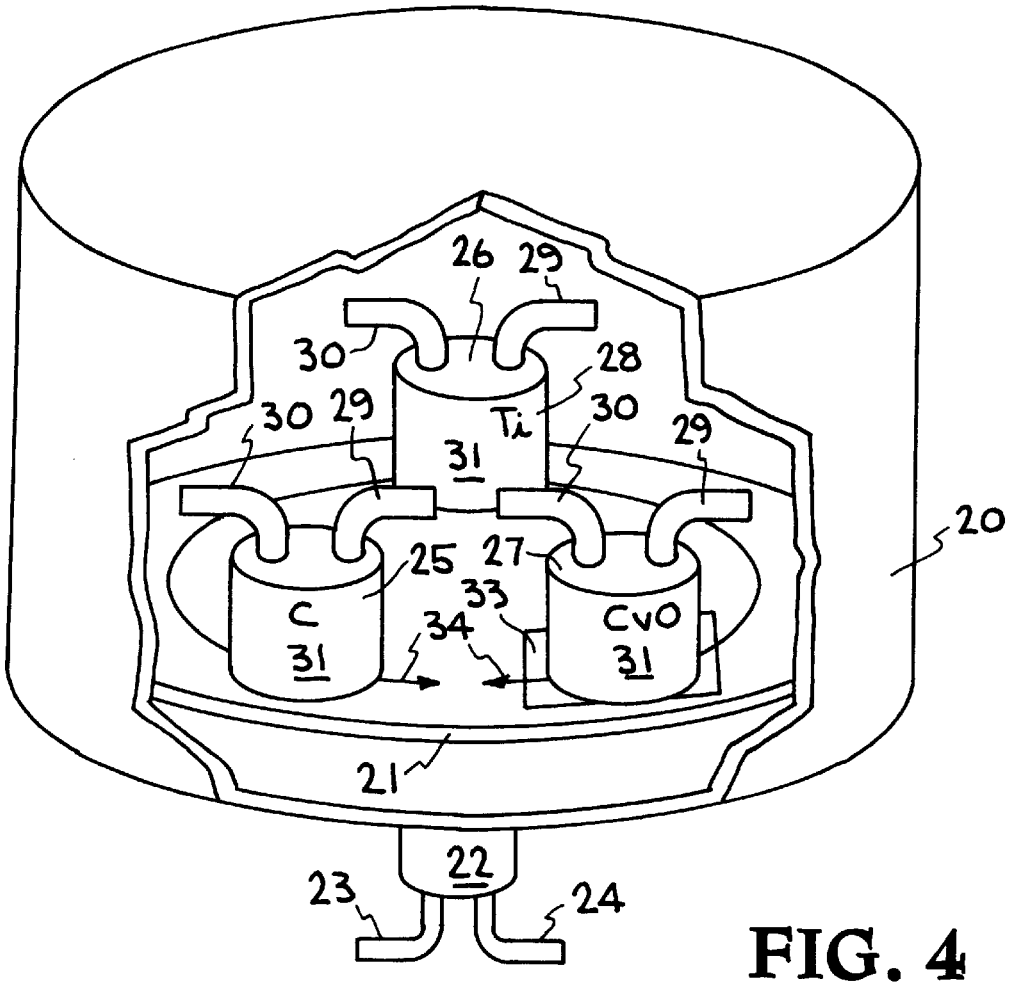
FIG. 4 illustrates schematically the construction of a vacuum coating system capable of fabricating both the two and three material reactive multilayers of FIG. 2 and FIG. 3A–3B.

The three material multilayer structure 5 of FIG. 2 may be fabricated by magnetron sputter depositing thin films of Ti, C, CuO, C, Ti, C, CuO, C etc. from individual magnetron sputtering sources onto a cooled surface or substrate that rotates under each source, such as illustrated in FIG. 4. Magnetron sputtering is a momentum transfer process that causes atoms to be ejected from the surface of a cathode or target material by bombardment of inert gas ions accelerated from a low pressure glow discharge. Magnetron sputtering is known in the art, as exemplified by U.S. Pat. No. 5,203,977 issued Apr. 20, 1993 to D. M. Makowiecki et al and U.S. Pat. No. 5,333,726 issued Aug. 2, 1994 to D. M. Makowiecki et al, and assigned to the same assignee. Thus a detailed description herein of a magnetron sputtering source and its operation is not deemed necessary.

The individual magnetron sources may be located and controlled such that the substrate is continuously rotated from one source to another using four (4) sources (i.e. Ti, C, CuO, C), or a three (3) magnetron assembly source may be used, and the substrate is rotated back and forth so as to provide sequential layers of Ti, C, CuO, Cu, Ti, C, etc.), as seen with respect to FIG. 4. A two magnetron source sputtering assembly is adequate for fabricating the two element RMLs.

Referring now to FIG. 4, a three source magnetron sputtering assembly is schematically illustrated, and which comprises a chamber 20 in which is located a rotating copper substrate table 21 provided with a substrate water cooling mechanism 22 having coolant inlet and outlets 23 and 24. Located and fixedly mounted above the rotating table 21 are three DC magnetrons 25, 26, and 27, equally spaced at 120° C., and being electrically negative, as indicated at 28. Each of the magnetrons 25, 26, and 27 is provided with water cooling inlets 29 and outlets 30. Located between each of the magnetrons 25–27 and the rotating table 21 is a cross contamination shield 31. Rotating table 21 is provided with an opening 32 in which is located a substrate 33 on which the thin films of reactive metal, carbon and oxide are deposited as the table 21 is rotated in opposite directions over the substrate 33 as indicated by the dash line and double arrow 34. The chamber 20 may include means, not shown, for providing a desired atmosphere for the sputtering operation, the type of atmosphere depending on the materials being sputtered.

In operation of the FIG. 4 assembly, and in conjunction with the above described embodiment, Magnetron 25 is indicated as a carbon (C) source, magnetron 26 as a Titanium (Ti) source, and magnetron 27 as a copper oxide (CuO) source. The table 21 is first rotated to the position shown, such that the substrate 33 is located beneath the CuO source 27 whereby a thin film (≧10 Å) 9 of CuO is deposited on substrate 33. The table 21 is then rotated so that the substrate 33 is located beneath the Ti source 26 whereby a thin film (≧10 Å) 8 of titanium is deposited on the CuO film 9. At this point, a second film of carbon may be deposited and/or the direction of rotation the table 21 reversed such that the substrate 33 is beneath carbon source 25, then back to the CuO source 27, then to the C source 25, then to Ti source 26, and so on until the desired number of layers of reactive metal, carbon and oxide are deposited on the substrate 33. After completion of the formation of the various layers on the substrate 33, the substrate may be removed, if desired, by polishing, etching, etc. as known in the art, to produce embodiment illustrated in FIG. 2.

While the above-exemplified fabrication process involved a Ti-C-CuO-C multilayer structure, the same sequence of steps using different magnetron sputter parameters, can be utilized to produce multilayer structures from other metal-carbon-oxide combinations, such as Al-C-CuO, Be-C-CuO, and Ti-Al-CuO, for example. Also, the multilayer structures of FIG. 2 can be highly stressed such that the multilayer structure disintegrate to produce a powder, such as shown at 6 in FIG. 1B. This is accomplished by adjusting the magnetron sputtering process parameters, especially the argon gas pressure, so as to produce a mechanically unstable multilayer film or foil.

Figure 3B:
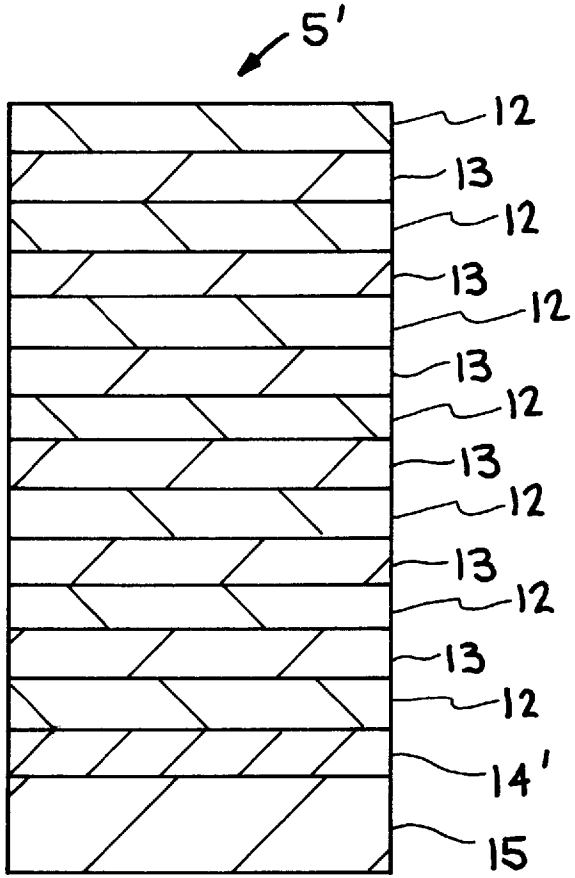
FIG. 3A and 3B are greatly enlarged views of a two material reactive multilayer, with FIG. 3B including a substrate on which the multilayers are deposited.
Figure 3A:
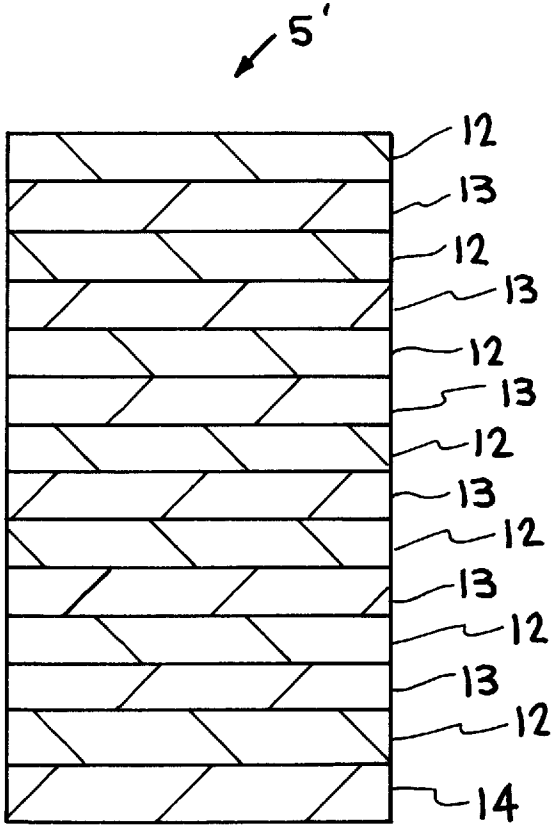

While the three element multilayer of FIG. 2 can effectively actuate the cartridge primer, the two element multilayer described hereinafter with respect to FIGS. 3A and 3B is preferred because it is easier to fabricate and there is a larger selection of reactive elements, and the heat produced thereby is sufficient to actuate the primer.

FIG. 3A is an enlarged cross-sectional illustration of a two material or element multilayer (RML) structure 5' using a sequence of titanium-boron (Ti—B), for example, wherein the alternating layers 12 and 13 of titanium and boron have a thickness in the range of 2–20 nm and may be deposited on a layer 14 of pure tin. FIG. 3B is similar to FIG. 3A except that the alternating Ti and B layers are deposited via tin layer 14 on a substrate 15, such as aluminum foil, having a thickness of 5 μm to 50 μm. The aluminum foil could be replaced with a foil composed of Ti, Cu, or an organic polymer (i.e., polypropylene).

The two material multilayer structure 5' of FIG. 3A comprises alternating titanium layers 12 and boron layers 13 deposited on a layer of pure tin 14; and as shown in FIG. 3B the alternating titanium-boron layers 12–13 are deposited on an aluminum substrate or film 15 via a layer 14' of pure tin. The layers of tin 14 or 14' may be located elsewhere in the multilayer, and more than one layer of tin may be utilized.

The two material multilayer structure of FIGS. 3A or 3B can be produced in an apparatus similar to that of FIG. 4, but with the process parameter modified for the deposition of only two elements, such as titanium and boron. Each of the layers or titanium and boron may have a thickness in the range of 1 to 1000 nm (10–10,000 angstroms), and the number of layers may vary 100 to 10,000, depending on the interfacial energy desired for a specific application. In addition to the alternating layers of Ti and B, the RML may be, but not restricted to Ni—Al, Zr—B, Ta—B, Nb—B, B—C, Al—C, Ti—C, Hf—C, Ta—C, Si—C, Ti—Al, Li—B, Li—Al, and Ni—Ti.

Three specific methods for forming a Boxer style primer utilizing an inorganic reactive (Ti—B) multilayer (RML) explosive material in place of, or in conjunction with, a commercial chemical initiator are set forth hereinafter.

I. LLCP Fabrication By Direct Deposition Method of the RML

The two element inorganic reactive multilayer, such as illustrated in FIG. 3A is directly deposited by magnetron sputtering of the elements into the cup portion 1 of a primer assembly, such as illustrated in FIG. 1B at 5. Generally, the layer 7 of pure tin would be deposited in the cup 1 prior to depositing the multilayer 5 thereinto. The following sets forth a specific example of a magnetron sputtering process for producing a two material multilayer film, foil, or coating composed of titanium-boron, for example, wherein the alternating layers of titanium and boron have a thickness in the range of 2–20 nm. The RML is fabricated in a vacuum coating system consisting of multiple magnetron sputtering sources and a rotating substrate table, such as illustrated in FIG. 4 modified for two material deposition.

1. Argon Sputter Gas Pressure: $3–15\times10^{-3}$ Torr.
2. Substrate: cartridge cup.
3. Substrate Temperature: 30° C.
4. Substrate to Sputter Source Distance: 7 cm.
5. Sputter Power: Boron, 350–450 watts Rf; Titanium, 60–200 watts DC.
6. Substrate Rotation Speed: 0.1–1.0 RPM.

II. LLCP Fabrication by RML Replacement Method

The two element inorganic reactive multilayer material, such as illustrated in FIG. 3A, is formed by magnetron sputtering, as in Example I above or by other metallurgical processes such as cold-rolling elemental ribbons. The RML is than converted into a powder, and used in place of the standard organic initiator explosive in mixture 2 in FIG. 1A as indicated at 6 in FIG. 1B. The process of Example 1 sets forth a specific example of this process. The reduction of a foil to powder is a standard process in powder metallurgy and ceramic technology. Powder can be produced directly from an RML foil by modifying the sputter deposition process described in Example 1. This is accomplished by depositing the RML at sputter gas pressures below 3 mtorr or above 15 mtorr, thus producing a highly stressed foil that readily disintegrates into a powder. The other process parameters are the same as those given in Example I. While FIG. 1B illustrates both the RML 5 and the RML powder 6, in cup 1, as example only the cup 1 can contain RML 5 only or RML powder 6 only.

III. LLCP Fabrication by RML Foil Method

The two element inorganic reactive multilayer of FIG. 3B is formed as a free-standing foil by a process such as cold-rolling of elemental ribbons or as a film by magnetron sputtering the elements directly on to an aluminum foil. A pre-form is then cut from the free-standing foil or the coated aluminum foil and placed directly in the primer cup 1 of FIG. 1A to replace the explosive mixture 2, and thus replace the RML powder 6 and/or the RML 5 of FIG. 1B. The process described in Example 1 can be used to coat the aluminum foil with the RML and it sets forth a specific example of this process. Also, the substrate (aluminum foil) may be composed of titanium or copper or an organic polymer.

Figure 5:
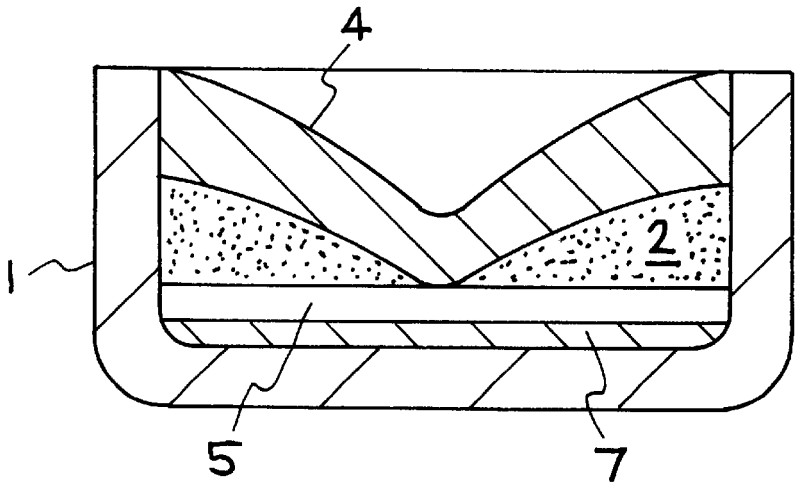
FIG. 5 illustrates in cross-section the construction of a primer using a combination of RML and a commercial chemical explosive as the primary initiator.

These three methods of fabricating limited-life cartridge primers replace the commercial chemical initiator (mixture 2 of FIG. 1A) currently used in the standard Boxer primer with a comparable amount of RML (components 5 and/or 6 of FIG. 1B). An alternate method of fabricating a LLCP involves the use of a small amount of RML to ignite the standard chemical initiator currently used in commercial primers. This method would require some modifications to the basic design of the Boxer primer. However, it would minimize both increases in manufacturing costs related to the RML materials and changes in primer performance. A modified Boxer primer design that would allow the RML to initiate a larger amount of commercial chemical explosive is illustrated in FIG. 5 wherein RML 5 and layer of tin 7 replaces a portion of the mixture 2 in cup 1. If desired the foil paper 3 of FIG. 1A can be utilized in FIG. 5 between the mixture 2 and anvil 4. The modification essentially involves removing the chemical explosive mixture from the firing-pin striking area of the primer between the anvil and the cup and replacing it with a tin layer and a RML foil. The modified Boxer type LLCP can be fabricated by the procedures set forth in Method I above.

Figure 6:
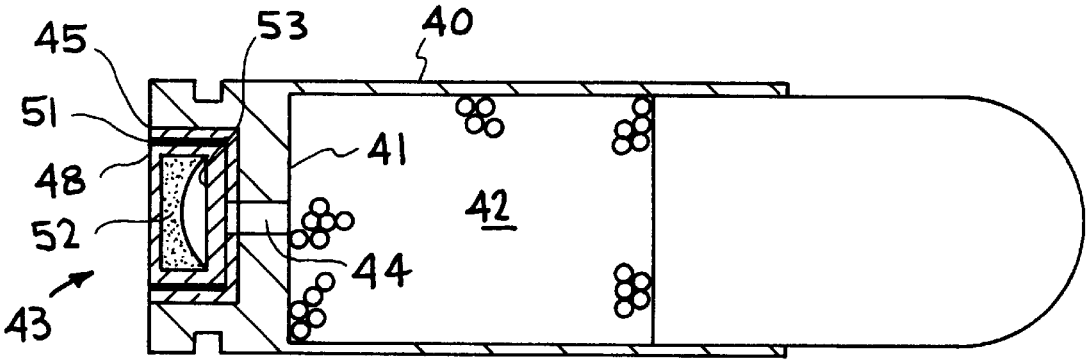
FIG. 6 illustrates in cross-section the construction of a cartridge with a primer using a combination of RML and a commercial chemical explosive as the primary initiator that can be detonated electronically with a spark from a low-voltage battery.
Figure 7:
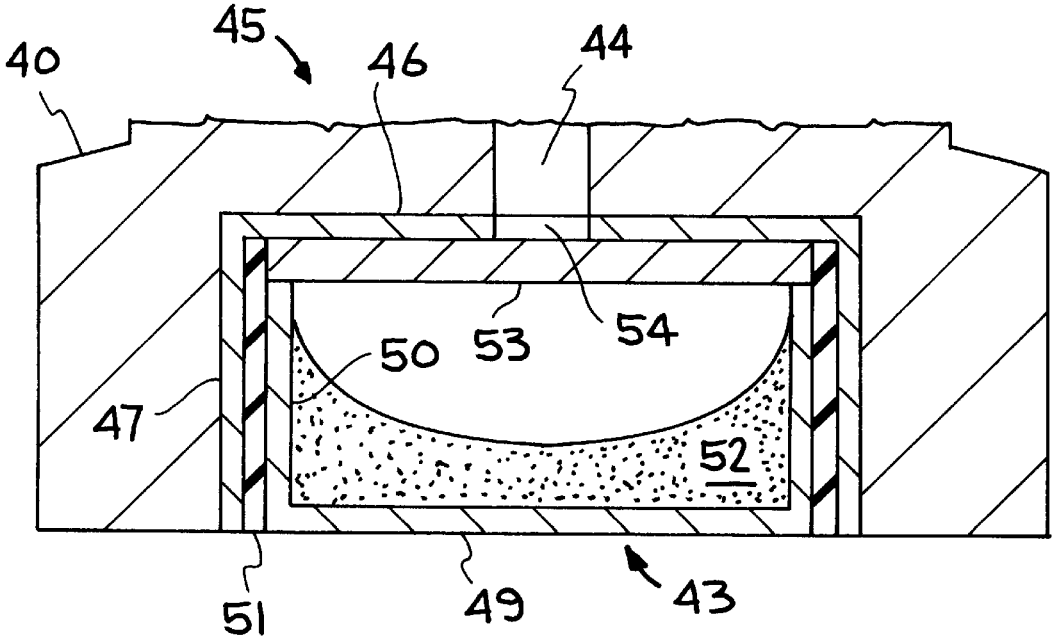
FIG. 7 is an enlarged cross-sectional view of a section of the FIG. 6 cartridge primer.
Figure 8:
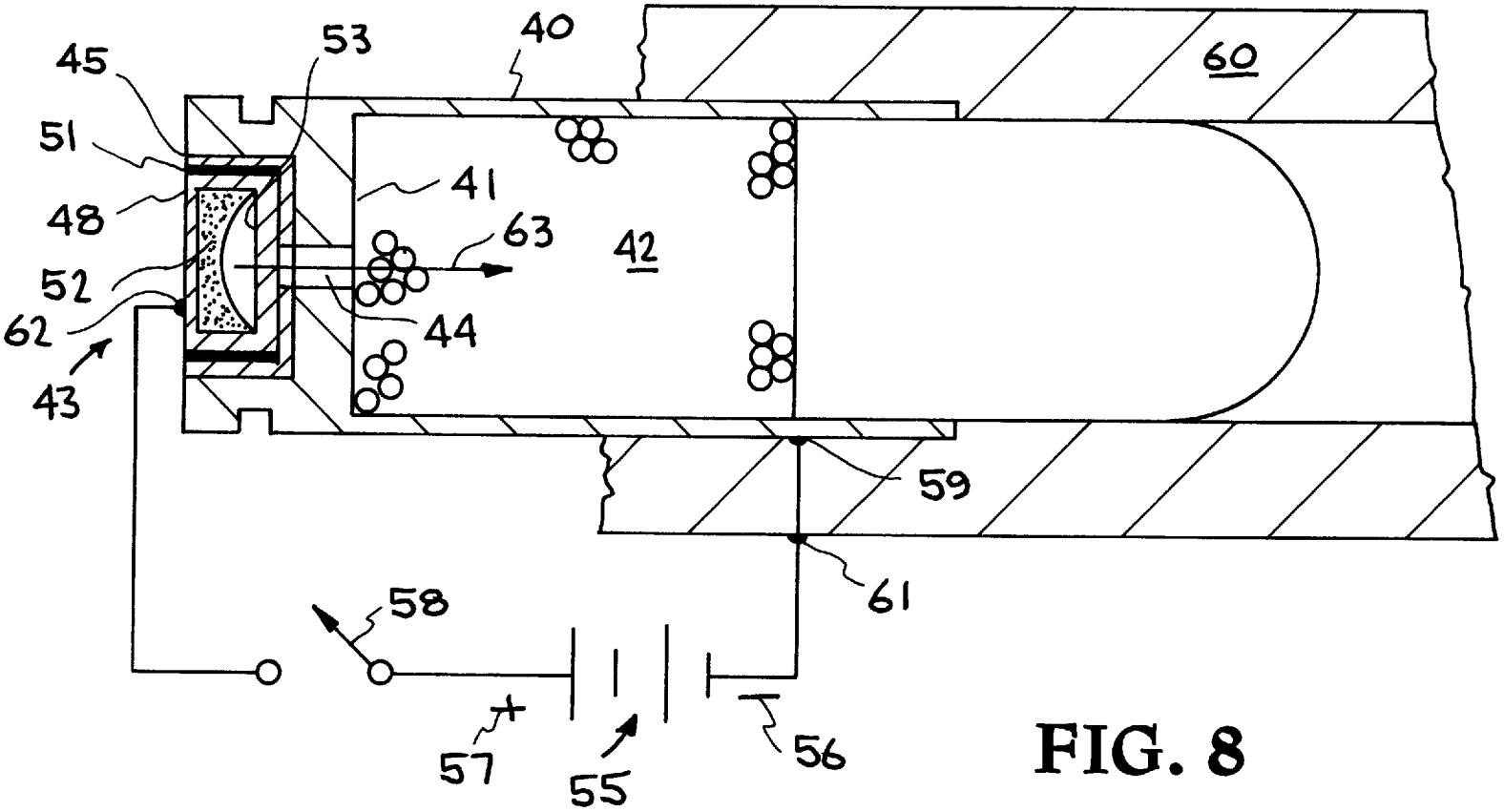
FIG. 8 is a schematic view of an electrical activator for cartridge primer of FIGS. 6–7.

FIGS. 6 and 7 illustrate an embodiment using an RML in a cartridge detonated electronically, with FIG. 7 being an enlarged view of a section of the FIG. 6 cartridge. As shown, a cartridge 40 includes a cavity 41 containing a powder charge 42, a primer, generally indication at 43, with a hole 44 interconnecting the cavity 41 and primer 43. The primer 43 includes an inverted large primer cup 45 having a bottom section 46 and wall section 47, a small primer cup 48 having a bottom section 49 and a wall section 50, an insulator 51 between wall sections 47 and 50, with small primer cup 48 containing a quantity of conventional chemical explosive 52, and an inorganic reactive multilayer (RML) 53 positioned adjacent the bottom section 46 and wall section 50 of small primer cup 48, as seen in FIG. 7. The small primer cup 48 is electrically insulated from the large primer cup 45 via insulator 51 and RML 53 while large primer cup 45 is connected electrically to cartridge 40 and the metal frame of the gun, as seen in FIG. 8. The RML 53 may be constructed from any of the multilayers of the types illustrated in FIGS. 2, 3A and 3B, but preferably of the 3B type with the reactive multilayers deposited on an aluminum foil. The bottom section 46 of larger primer cup 45 is provided with an opening 54 which aligns with hole 44 in cartridge 40.

In operation, as seen with respect to FIG. 8, the primer 43 of cartridge 40 is electrically activated via a power supply, such as a battery 55 having a negative terminal indicated at 56 and a positive terminal indicated at 57, and a switch, generally indicated at 58, connected between battery 55 and primer 43. Battery 55 may, for example, be of a 1.5–100 V type, with a 9 volt small conventional battery being sufficient. The primer 43 of cartridge 40 is activated as follows:

1. The negative terminal 56 of battery 55 is in electrical contact with the inverted large primer cup 45 via the case of cartridge 40, as indicated at 59 in FIG. 8, via the metal frame of a gun 60, as indicated 61.
2. The battery 55 can be stored in a hollow portion of the gun such as in the pistol grip.
3. The positive terminal 57 of battery 55 is in electrical contact with the small primer cup 48 of primer 43, as indicated at 62, via the switch 58. This may be accomplished using a separate and isolated probe which includes switch 58 and which attached to positive lead or terminal 57 of battery 55.
4. Firing of the primer 43 is accomplished by completing the circuit whereby current is allowed to pass from the large primer cup 45 through the small primer cup 48 via the RML 53.
5. Passing 9 volts, for example, through the RML 53 will cause it to ignite, causing ignition of explosive 52 in small cup 48, as indicated by arrow 63 in hole 44, and thereby initiating the larger charge 42 of standard chemical in initiator materials in cavity 41 of cartridge 40.

It has thus been shown that the present invention provides limited-life primers and detonators which can be designed to become inactive in a predetermined time. By using an inorganic reactive multilayer material no hazards to the environment are produced, and the sensitivity is determined by the physical structure and the stored interfacial energy. The sensitivity lowers with time, and thus time-dependent interdiffusion is predictable, thereby enabling the determination of the life-time of the primer. Incorporation of a phase changing material prevents extension of the primer life-time by low temperature storage.

While specific process examples, embodiments, materials, parameters, etc. have been set forth to describe the invention, such are not intended to be limiting. Modifications and changes may become apparent to those skilled in the art, and it is intended that the scope of the invention be limited only by the appended claims.

What is claimed is:

1. An improved cartridge primer having a casing containing at least a quantity of inorganic reactive multilayer material, said inorganic reactive multilayer material having time-dependent interdiffusion of elements occurring at interfaces of the multilayer material which reduces stored energy and reactivity thereby producing a limited-life of the cartridge primer.

2. The improved cartridge primer of claim 1, wherein said inorganic reactive material is in the form of a powder.

3. The improved cartridge primer of claim 1, wherein said inorganic reactive material is in the form of a multilayer material pre-form including a foil base.

4. The improved cartridge primer of claim 1, wherein said inorganic reactive multilayer material is selected from the group consisting of two material multilayers, three material multilayers, and combinations of two and three material multilayers.

5. The improved cartridge primer of claim 4, additionally including a quantity of material that has a change at low temperature selected from one of a destructive phase change, a thermal contraction change, and an internal stress change.

6. The improved cartridge primer of claim 4, wherein said inorganic reactive multilayer materials are composed of two material multilayers having alternating layers.

7. The improved cartridge primer of claim 6, wherein said alternating layers are selected from the group consisting of Ti—B, Zr—B, Ta—B, Nb—B, B—C, Al—C, Hf—C, Ti—C, Ta—C, Si—C, Ni—Al, Ti—Al, Li—B, Li—Al, and Ni—Ti.

8. The improved cartridge primer of claim 5, wherein said quantity of material is composed of tin.

9. The improved cartridge primer of claim 6, wherein said alternating layers are on a foil composed of materials selected from the group consisting of aluminum, nickel, and copper.

10. The improved cartridge primer of claim 9, wherein said foil containing said deposited alternating layers is converted to pre-forms containing sections of said foil and said deposited alternating layers of reactive materials.

11. The improved cartridge primer of claim 1, wherein said reactive multilayer material is highly stressed so as to disintegrate to a powder of inorganic reactive material.

12. The improved cartridge primer of claim 2, wherein said reactive material multilayer is composed of layers of three materials, selected from the group consisting of Ti—Al—CuO, Ti—C—CuO, Be—C—CuO, and Al—C—CuO.

13. The improved cartridge primer of claim 1, wherein said reactive multilayer material is converted to a powder of reactive material.

14. The improved cartridge primer of claim 1, wherein said reactive multilayer material is composed of alternating layers of two materials deposited on a foil composed of materials selected from the group consisting of aluminum, nickel and copper.

15. The improved cartridge primer of claim 14, wherein said alternating layers of two materials are selected from the group consisting of Ti—B, Zr—B, Ta—B, Nb—B, Al—C, Ti—C, HfC, Ta—C, Si—C, Ni—Al, Li—B, Li—Al, and Ni—Ti.

16. The improved cartridge primer of claim 14, wherein said foil containing said deposited alternating layers is converted to pre-forms containing sections of said foil and said deposited alternating layers of reactive materials.

17. The improved cartridge primer of claim 4, wherein said inorganic reactive materials for a multilayer material are deposited on a foil composed of materials selected from the group consisting of aluminum, nickel and copper.

18. The improved cartridge primer of claim 17, wherein said foil containing said deposited multilayer material is converted to pre-forms containing sections of said foil and said deposited multilayer reactive materials.

19. The improved cartridge primer of claim 4, wherein said reactive material multilayer is composed of layers of three materials, selected from the group consisting of Ti—Al—CuO, Ti—C—CuO, Be—C—CuO, and Al—C—CuO.

20. The improved cartridge primer of claim 19, wherein said reactive multilayer material is converted to a powder of reactive material.

21. A cartridge primer according to claim 1 having a casing containing at least a quantity of multilayer material composed of inorganic reactive materials, said multilayer material consisting of alternating layers of titanium and boron.

22. The limited-life cartridge primer of claim 21, additionally including a quantity of inorganic reactive material consisting of a powder composed of titanium and boron.

* * * * *